US005358160A

United States Patent [19]

Bianchi

[11] Patent Number: 5,358,160

[45] Date of Patent: Oct. 25, 1994

[54] PISTOL CARRYING DEVICE AND RETENTION SYSTEM

[76] Inventor: John E. Bianchi, 17 Buena Vista Ct., Rancho Mirage, Calif. 92270

[21] Appl. No.: 71,543

[22] Filed: Jun. 4, 1993

[51] Int. Cl.[5] ..... F41C 33/02

[52] U.S. Cl. ..... 224/244; 224/192; 224/193; 224/206; 224/198; 224/238; 224/243; 224/911; 224/912

[58] Field of Search ..... 224/911, 912, 192, 193, 224/198, 206, 238, 243, 244, 205, 208

[56] References Cited

U.S. PATENT DOCUMENTS

| | | | |
|---|---|---|---|
| 38,213 | 4/1863 | Bennett | 224/238 |
| 1,166,781 | 2/1916 | Parrish . | |
| 1,557,339 | 10/1925 | Sander . | |
| 1,768,177 | 6/1930 | Wanee . | |
| 2,109,734 | 3/1938 | Preneta . | |
| 2,297,008 | 9/1942 | McMillan | 224/243 |
| 2,764,326 | 9/1956 | Stanton . | |
| 2,917,214 | 12/1959 | Resnick . | |
| 3,583,611 | 6/1971 | Theodore . | |
| 3,688,953 | 9/1972 | Bianchi | 224/192 |
| 3,828,990 | 12/1972 | Baldocchi . | |
| 4,260,087 | 4/1981 | Leaver . | |
| 4,721,238 | 1/1988 | Shoemaker . | |
| 4,747,634 | 5/1988 | Hoke . | |
| 4,925,075 | 5/1990 | Rogers . | |
| 5,012,965 | 5/1991 | Miller . | |
| 5,094,376 | 3/1992 | Baruch | 224/243 |

OTHER PUBLICATIONS

Bianchi, John E., "Blue Steel & Gunleather", Second Edition, 1986, ISBN 0-917714-15-6.

Article entitled "Hideout Holsters" in Jul. 1993 issue of Guns & Ammo Magazine.

*Primary Examiner*—Ernest G. Cusick
*Attorney, Agent, or Firm*—Loyal M. Hanson

[57] ABSTRACT

An ambidextrous pistol carrying device of conveniently and inexpensively fabricated modular design includes a mainframe member of non-leather composition, an elongated spring member and a guard strap member connected to the mainframe member, and components for removably connecting a shoulder harness. The mainframe member includes a muzzle retainer portion that extends across and abuts the muzzle of a pistol, a bore-engaging protrusion on the muzzle retainer portion that extends at least partially into the bore, and left and right arm portions that extend from the muzzle portion along the sides of the pistol to positions above the trigger guard. The spring member extends across the rearward portion of the pistol between the left and right arm portions to spring bias the pistol toward the muzzle retainer portion. The guard strap member includes a strap of flexible material that fastens together through the trigger guard in order to inhibit premature trigger finger contact of the trigger when the pistol is drawn. Fastener components enable removable connection of a shoulder harness to the muzzle retainer portion and the rearward ends of the left and right arm portions. The pistol retention system includes a removable shoulder harness, and an ambidextrous shoulder harness is disclosed that includes three straps connected pivotally to enable a user to convert the shoulder harness for either lefthand or righthanded use.

13 Claims, 5 Drawing Sheets

PISTOL CARRYING DEVICE AND RETENTION SYSTEM

BACKGROUND OF THE INVENTION

Technical Field

This invention relates generally to rigs for carrying firearms. More particularly, it relates to a revolutionary non-leather pistol carrying device and removable shoulder harness that depart from conventional designs to take advantage of modern materials and modular construction in an ambidextrous configuration that achieves handgun security and comfort, enables speed of draw and access, and accommodates various pistol calibers and frame sizes.

Background Information

Non-leather construction has some advantages over conventional gunleather. It costs less, withstands body chemicals and foul weather better, and requires less maintenance. It can provide a modern, hi-tech appearance and use many non-gunleather colors. Recognizing these advantages, some evolving holster designs employ modern fabrics, plastics, and metals instead of, or in combination with, conventional gunleather.

But achieving just the right combination of look, feel, balance, and performance remains elusive. That is particularly so in designing a non-leather rig to replace conventional shoulder holsters. The rig must ride comfortably on the upper body while securely retaining a handgun in a quickly accessible underarm position. Law enforcement personnel want it to lie unnoticeably under a jacket or other outer garment. Pilots and other military personnel require that it meet rigid military specifications. However, existing non-leather rigs fail to measure up in many respects and so a better design remains desired.

SUMMARY OF THE INVENTION

This invention breaks with the past by providing the needed design in the form of a lightweight, skeletonized, pistol retention system that mates a non-leather pistol carrying device with a removable shoulder harness. The pistol carrying device features a conveniently fabricated, open-frame, modular design having a mainframe member, a retainer spring, and a trigger guard strap. Those three components, or modules, cooperate to effectively carry a pistol with non-leather advantages and significantly less weight and bulk. The shoulder harness preferably hooks onto the pistol carrying device with snap fasteners and it may take the form of the quick-release, ambidextrous, one-size-fits-all shoulder harness subsequently described.

Concerning the mainframe member of the pistol carrying device (the "mainframe"), it includes a muzzle retainer portion (the "muzzle retainer") and spaced apart left and right side portions (the "arms"). The muzzle retainer extends across and abuts the forward end of the barrel (i.e., the muzzle) and the arms extend rearwardly from the muzzle retainer along opposite sides of the barrel to positions above the trigger. Thus, the mainframe employs minimal structure. Preferably molded of plastic, it can be fabricated conveniently and inexpensively for later assembly with the retainer spring and trigger guard strap—a vast difference from the high-skill and labor-intensive task of wet molding gunleather.

The muzzle retainer and the arms of the mainframe are shaped and dimensioned to receive the forward end of the pistol in the position just described, with the muzzle retainer extending transversely across and abutting the muzzle. In that position, a protruding nipple on the muzzle retainer extends partially into the bore to restrain the muzzle against lateral movement. Preferably, the protrusion has a tapered shape in order to accommodate various pistol calibers. It is preferably molded, machined, or otherwise fabricated with the muzzle retainer and the two arms in integral one-piece mainframe construction as the main modular component of the pistol carrying device.

The spring member (the "spring") is an elongated member—preferably a coiled metal spring constructed according to another aspect of the invention with eyelet screws and a protective vinyl jacket. The spring forms another modular component that can be separately fabricated for later assembly. It rivets onto or otherwise attaches to rearward ends of the left and right arms of the mainframe member. So attached, it extends from the rearward end of the left arm, behind the rearward end of the pistol, and to the rearward end of the right arm. Extending along that path, the spring holds the pistol in position within the mainframe while spring biasing the muzzle toward the muzzle retainer (e.g., with about 20–30 pounds of pressure). Meanwhile, the vinyl jacket inhibits metal-to-metal contact between spring and pistol. It also helps keep the coils of the spring from pinching skin on the user's hand.

The trigger guard strap, or just guard strap, is a flexible member with a leftside portion and a rightside portion. It is fabricated as another modular component for later assembly, and, according to still another aspect of the invention, it may include a large snap fastener with spacer relief. The leftside and rightside portions attach to the left and right arms (preferably riveting onto the arms with the spring) and they extend downwardly on opposite sides of the pistol from the left and right arms to opposite sides of the trigger guard. There, the leftside and rightside portions snap together through the trigger guard. That arrangement guards the trigger against premature trigger finger contact when the pistol is drawn. It also further stabilizes the pistol within the mainframe.

Thus, the modular components of the pistol carrying device can be conveniently and expensively fabricated at different locations for later assembly with minimal skill and tooling. Once assembled, the mainframe, spring, and guard strap cooperate to effectively and more securely hold the pistol while using minimal structure for less bulk and weight and resultant greater gun concealment possibilities. They do so in just the right way—for the right look, feel, balance, and performance. Durable non-corrosive materials avoid harming the pistol and they are not affected like conventional gunleather by body acids or other atmospheric conditions. In addition, the design lends itself to the use of materials appropriate for most all temperature extremes. Furthermore, the device is ambidextrous in that it is suited for lefthand and righthand use.

Significant cost savings result. Recall that holster manufacturers must often design, fabricate, and stock thousands of holster models that fit the fifty or so currently popular semiautomatic pistol styles having various frame styles and sizes and one of the four most popular barrel lengths (i.e., $3\frac{1}{2}$, 4, $4\frac{1}{2}$, and 5 inch barrels). In addition to those variables, the manufacturer must often have black leather and brown leather models, lefthanded and righthanded models, and basketweave and plain leather models. With the open-frame, ambidextrous, non-gunleather pistol carrying device of this invention, however, the manufacturer need only carry only four models, one for each of of the four sizes. In other words, the pistol carrying device accommodates different calibers and different frame style and sizes, and it can forego color and leather types, so only four models are required for the four barrel lengths.

The ambidextrous attribute of the shoulder harness adds to that convenience and cost savings. It is ambidextrous in the sense that it is suited for lefthand and righthand use. In other words, it can be converted by arranging it for use on the left shoulder by a righthanded person, or for use on the right shoulder by a lefthanded person. For that purpose, the shoulder harness includes three flexible straps that are connected together pivotally with a large grommet or other suitable means. Each strap has a first end portion, and the three first end portions overlap so that one of the straps is sandwiched in between the other two. The grommet holds them together pivotally in that overlapping relationship so that the straps can be pivoted about the grommet. That enables the user to arrange the straps appropriately for either lefthand or righthand use. It also simplifies fabrication.

The following illustrative drawings and detailed description make the foregoing and other objects, features, and advantages of the invention more apparent.

DESCRIPTION OF THE PREFERRED EMBODIMENTS

Pistol Retention System

Figures 1, 2:
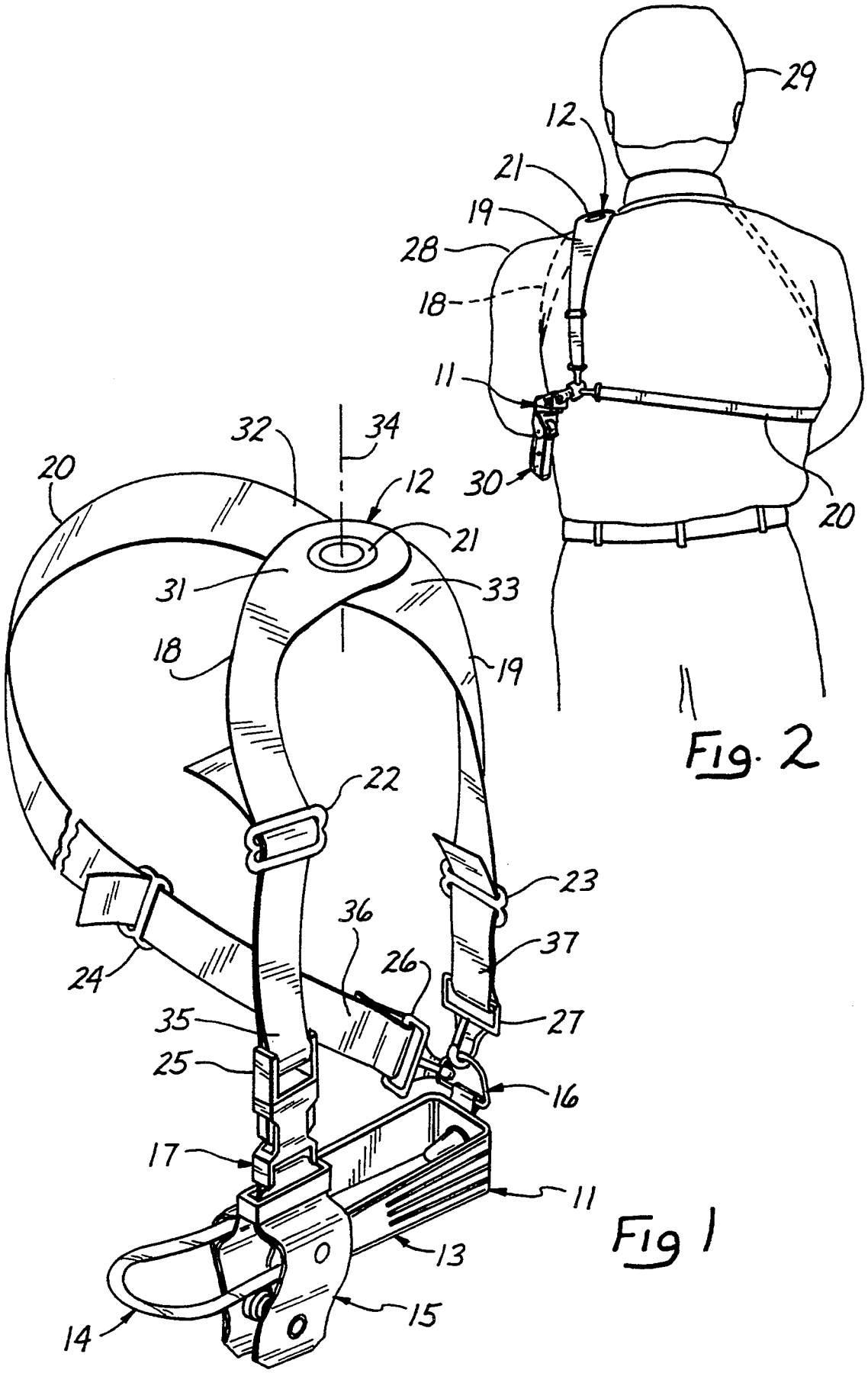
FIG. 1 of the drawings is a pictorial view of a pistol retention system constructed according to the invention.
FIG. 2 is a rear view of a user wearing the pistol retention system on the left side of his upper body.

FIG. 1 of the drawings shows a pistol retention system 10 constructed according to the invention. Generally, it includes a pistol carrying device 11 and a shoulder harness 12. A mainframe member 13, retainer spring 14, and guard strap 15 combine with forward and rearward fastening arrangements 16 and 17 to form the pistol carrying device 11. Three flexible straps 18, 19 and 20 that are pivotally connected together with a grommet 21 and outfitted with keepers 22, 23, and 24 for adjustability, combined with fasteners 25, 26, and 27 to form the shoulder harness 12.

The illustrated shoulder harness 12 is arranged for righthanded use on the left shoulder 28 of a righthanded person 29 (FIG. 2). It rides on the left shoulder 28 and fastens to the pistol carrying device 11 in order to carry a pistol 30. To use the shoulder harness 12 that way, the person 29 positions it so that the grommet 21 rests on the left shoulder 28, the first strap 18 extends downwardly in front of the left shoulder, the second strap 19 extends downwardly behind the left shoulder, and the third strap 20 extends from the left shoulder, behind the neck, in front of the right shoulder, and behind the back to a position below the left shoulder. Positioned that way and fastened to the pistol carrying device 11, the shoulder harness 12 supports the pistol carrying device 11 on the upper body of the person 29 along with the pistol 30.

Shoulder Harness

The straps 18, 19 and 20 of the shoulder harness 12 are composed of a flexible material so that they can conform to the user's body. For that purpose and for added comfort, the straps 18, and 19 may include an outer layer of synthetic leather bonded to an inner layer of suede material, such as the poromeric leather-look-alike material commercially available under the trademark PERMAIR from Permair Leathers of Peabody, Me. The strap 20 may take the form of an elastic strap that yields to the user's body movement. Of course, other flexible compositions may be employed for the straps, including nylon webbing.

Each strap has a first end portion, designated in FIG. 1 as first end portions 31, 32, and 33, and they are connected together pivotally in overlapping relationship by the grommet 21 so that one of the straps (e.g., the third strap 20) is sandwiched in between the other two straps (FIG. 1). That enables the straps to be pivoted relative to one another about a grommet axis 34 extending through the central opening of the grommet 21. For that purpose, the grommet 21 may take the form of the large brass grommets used in the canvas industry to provide a reinforced hole for rope and fasteners. It may have an outer diameter of about one inch (2.54 cm) and an inner diameter of about one-half inch (1.27 cm). Of course, those dimensions may vary within the broader inventive concepts disclosed and other hardware may be employed instead of a grommet to pivotally connect the straps together.

Each strap also has a second end portion, designated in FIG. 1 as second end portions 35, 36, and 37, and they connect to fasteners 25, 26, and 27. Conventional keepers 22, 23, and 24 enable adjustment of the second end portions for purposes of adjusting strap length between the grommet 21 and the fasteners 25, 26, and 27. Any of various fasteners may be employed that mate with the fasteners 16 and 17 on the pistol carrying device 11. The illustrated shoulder harness 12 uses a known type of quick-release buckle of plastic composition for the mating fasteners 17 and 26. It may, for example, take the form of the quick-release buckle used on military and mountaineering equipment that is available from ITW Corporation of Woodale, Ill. For the fasteners 26 and 27, metal hooks are employed that mate with a clip and D-ring arrangement used as the fastener 16 on the pistol carrying device 11. A suitable clip and D-ring arrangement is available from North and Judd in Massachusetts.

To convert the shoulder harness 12 to lefthanded use, for use on the right shoulder by a lefthanded person, the user disengages the fastener 25 from the fastener 17, rotates the fastener 25 one-half turn (i.e., 180 degrees in a clockwise direction looking downwardly at the fastener 25), and reinserts it into the fastener 17. Next, he disengages the fastener 26 from the fastener 16, pivots the first end portion 32 one-half turn about the pivot axis 34, and refastens the fastener 26 to the fastener 16.

That readies the shoulder harness for placement upon the right shoulder.

Pistol Carrying Device

Figure 3:
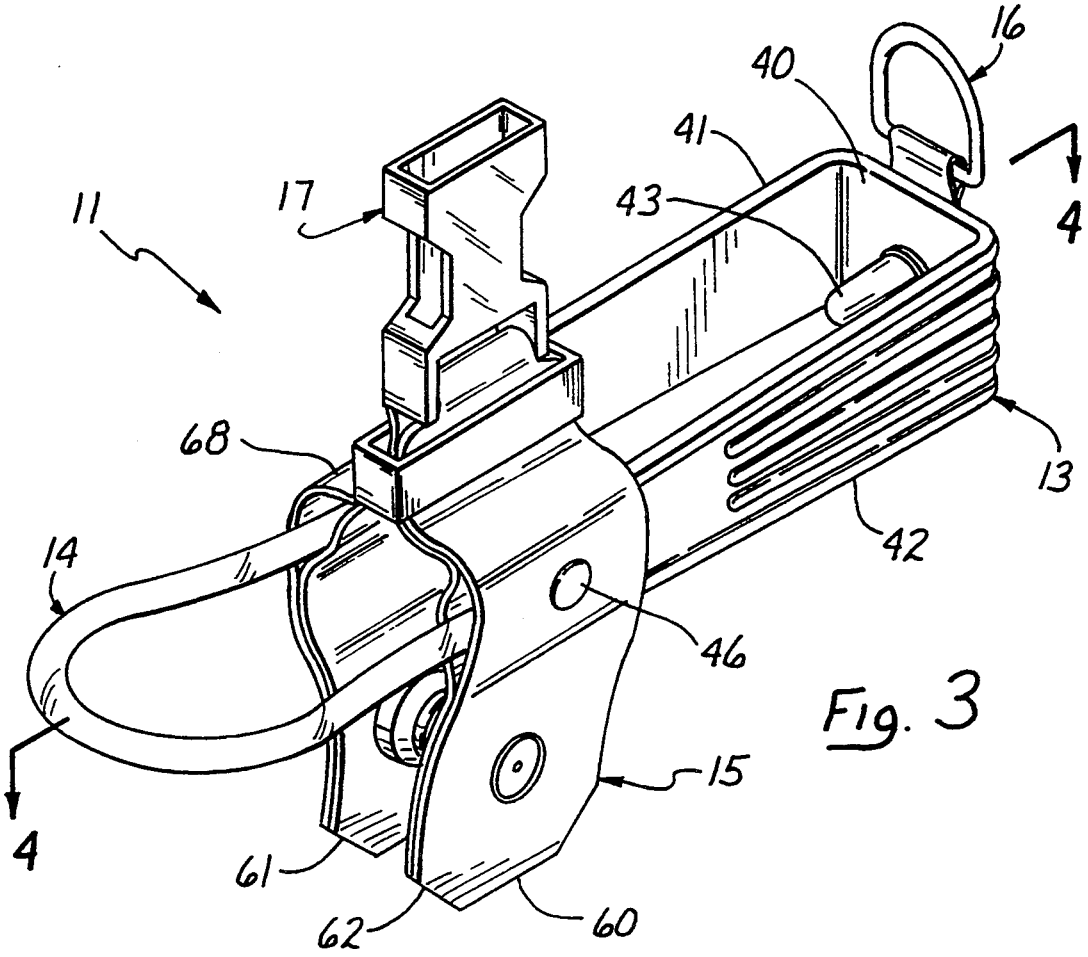
FIG. 3 is an enlarged perspective view of the pistol carrying device with the shoulder harness removed.
Figure 4:
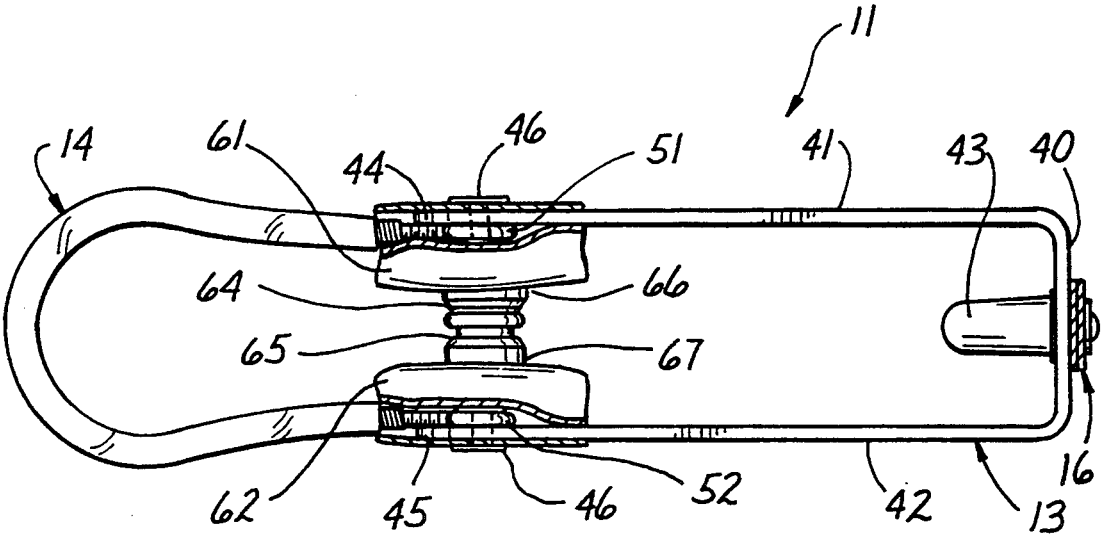
FIG. 4 is a cross sectional view of the pistol carrying device taken in a horizontal plane through the line 4—4 in FIG. 3.
Figure 5:
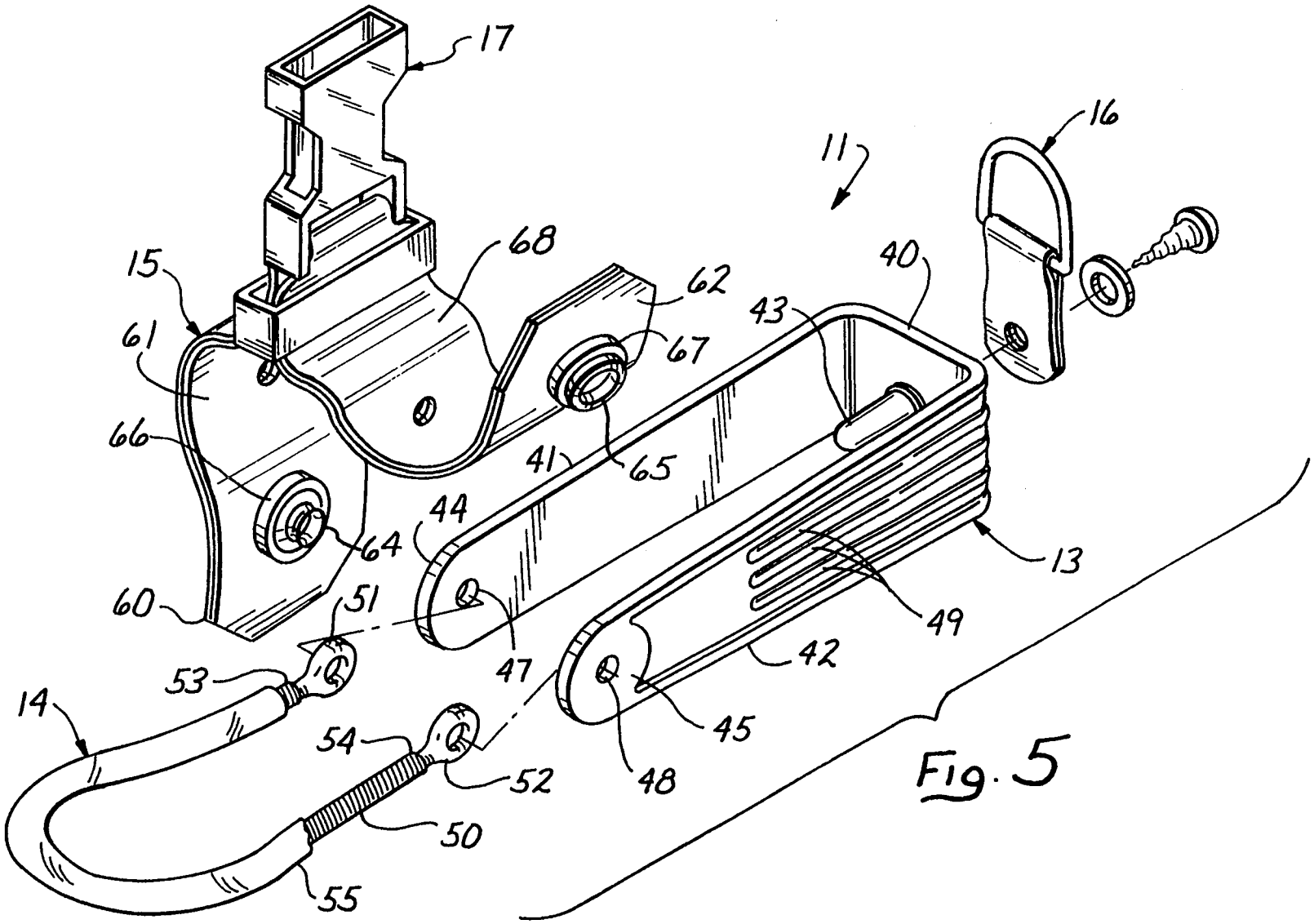
FIG. 5 is an exploded view of the pistol carrying device showing further details of construction.

The pistol carrying device 11 does not need to be converted, however. It is suited for both lefthanded and righthanded use without conversion. FIGS. 3–5 show further details of construction.

The mainframe member 11 includes a muzzle retainer portion 40, elongated left and right side members or arms 41 and 42 connected to it, and a bore-engaging protrusion 43 extending from it. Those elements are preferably molded, machined, or otherwise fabricated in unitary one-piece construction of a rigid material. Preferably, the mainframe member 11 is made lightweight and with the minimum bulk required to hold the pistol 30 in the manner subsequently described. The illustrated mainframe member 11 is a molded plastic component for that purpose and for making fabrication more convenient and inexpensive.

The protrusion 43 has a diameter sufficiently small to enable it to extend at least partially into the bore of the pistol 30, protruding toward the bore, for example, about $\frac{3}{4}$ inch (1.90 cm). In addition, the protrusion 43 may be tapered so that it will fit into bores of various calibers (e.g., 9 mm, 0.40 caliber, and 0.45 caliber bores). The muzzle retainer portion 40 is sufficiently large to support the protrusion 43 and to extend across the muzzle of the pistol 30, transverse to the bore, between the arms 41 and 42. The illustrated muzzle retainer portion 40 spaces the arms 41 and 42 about $1\frac{1}{4}$ inch (3.18 cm), and that enables the arms 41 and 42 to extend in generally parallel relationship (perhaps diverging somewhat) as they extend along opposite sides of the pistol 30. The spacing between the arms 41 and 42 may be a little larger than necessary for a particular pistol frame size in order to accommodate various pistol frame-slide widths.

The arms 41 and 42 extend from the muzzle retainer portion 40 along opposite sides of the pistol 30 to rearward end portions 44 and 45 at positions above the trigger of the pistol. Rivets 46 (FIGS. 3 and 4), or other suitable fasteners, extend through holes 47 and 48 (FIG. 5) in the rearward end portions to connect the retainer spring 14 and the guard strap 15 to the mainframe member 13. As a further idea of arm size, the illustrated arms 41 and 42 extend about four inches (10.2 cm) rearwardly from the muzzle retainer portion 40 to the center of holes 47 and 48 for use with a 0.45 caliber pistol with a $4\frac{1}{4}$ inch barrel. Ribs 49 are integrally molded with the arms 41 and 42 to add rigidity.

The retainer spring 14 includes a helically wound metal spring 50 (FIG. 5) having first and second ends 51 and 52 (FIGS. 4 and 5) in the form of eyelet screws with threaded shanks that are screwed into ends 53 and 54 of the spring 50. The illustrated spring 50 accepts a 3/32 inch threaded shank that way. The first and second ends 51 and 52 are connected to the rearward end portions 44 and 45 of the arms 41 and 42 with the guard strap 15 as previously described.

The spring 50 is of sufficient length (e.g., about 9 inches) to extend across the rearward portion of the pistol 30 under the tang of the pistol. In other words, it is shaped and dimensioned to extend across the rearward portion of the pistol in order to spring bias the pistol toward the muzzle retainer portion 40 of the mainframe member 13. It is configured to spring bias the pistol with about 20–30 pounds of force. A jacket 55 of non-metallic material (e.g., quarter inch vinyl surgical tubing) extending over the spring 50 inhibits metal-to-metal contact between the spring 50 and the pistol 30. It also helps keep the coils of the spring 50 from pinching the user's skin, particularly the skin web between thumb and index finger.

The guard strap 15 includes a strap 60 of flexible material (FIGS. 3 and 5) that has a leftside portion 61 connected to the rearward end 44 of the left arm 41 and a rightside portion 62 connected to the rearward end 45 of the right arm 42. The illustrated strap 60 takes the form of a length of synthetic leather that is double back against itself so that the leftside and rightside portions 61 and 62 have two layers.

The guard strap 15 includes means for removably fastening the leftside and rightside portions 61 and 62 together through the trigger guard of the pistol 30 in order to inhibit premature trigger finger contact of the trigger when the pistol 30 is drawn. That function is accomplished in the illustrated embodiment with mating first and second fastener components 64 and 65 (e.g., mating male and female 0.5 inch diameter snap fastener components). They are attached to the leftside and rightside portions 61 and 62 using spacer components 66 and 67.

Each fastener component has a post that extends through the strap 60 in a known way. The fasteners are chosen so that the post is larger than necessary to extend through the $\frac{1}{8}$ inch thick strap 60. They may take the form of the fasteners known as durable fasteners and have a post that is about $\frac{1}{8}$ inch longer than necessary, for example. That way, each fastener component extends about $\frac{3}{8}$ inch beyond the strap 60. The fastener components snap together then with about $\frac{1}{2}$ inch spacing resulting between the leftside portion 61 and rightside portion 62 of the guard strap 15.

Spacers 66 and 67 are used with the fastener components. They may take the form of $\frac{5}{8}$ inch diameter, 5/16 inch thick, compressible grommets available from Brainer of East Rochester, N.Y. (part number 439). They provide spacing by accommodating the extra post length because the post of each fastener must extend through both the spacer and the strap 60. The spacers also serve to inhibit metal-to-metal contact between the fasteners and the pistol 30 because they have a greater diameter than the fastener components. To add some strength and rigidity, metal plates (not shown) may be positioned between the two layers of the leftside and rightside portions 61 and 62 before attaching the fastener components 64 and 65.

The pistol carrying device 11 includes means for removably connecting a shoulder harness to the mainframe member 13. The forward and rearward fastening arrangements 16 and 17 serve that function. The forward fastening arrangement 16 may take the form of the clip and D-ring arrangement previously described. It screws or otherwise suitably attaches to the muzzle retainer portion 40 and it combines with the hook fasteners 26 and 27 on the shoulder harness 12 to removably connect the shoulder harness to the muzzle retainer portion. The rearward fastening arrangement 17 may take the form of the quick release buckle previously described. It attaches to an upper portion 68 of the strap 60 that extends over the pistol 30. In other words, the strap 60 is dimensioned and arranged to form a yoke that extends over the pistol between the leftside and rightside portions 61 and 62. That way, the upper portion 68 combines with the fastening arrangement 17 on the pistol carrying device 11 and the fastener 25 on the shoulder harness 12 to removably connect the shoulder harness to the rearward ends 44 and 45 of the left and right arms 41 and 42. The yoke configuration also helps stabilize the pistol 30.

Operation

Figure 6:
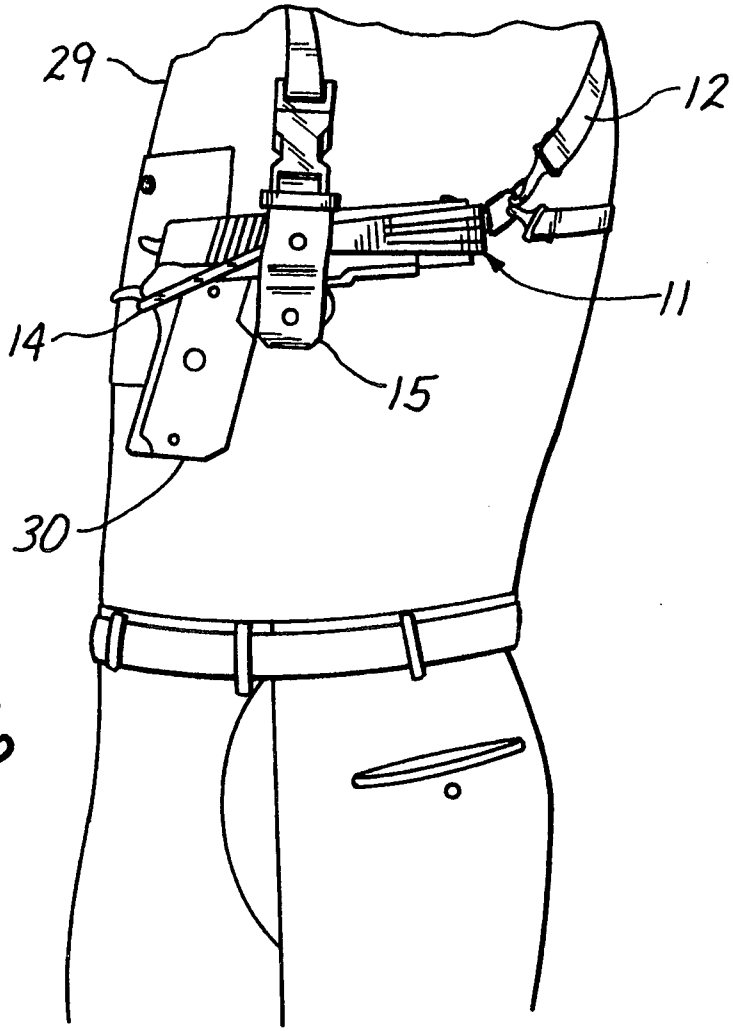

In use, the pistol carrying device 11 functions with the shoulder harness 12 to hold the pistol 30 on the upper body of the person 29 in an underarm position as shown in FIG. 6. The retainer spring 14 extends across the rearward portion of the pistol 30 to help hold the pistol in the carrying device. It engages the pistol 30 under the tang 69. The guard strap 15 connects together through the trigger guard to inhibit premature trigger finger contact with the trigger.

Figure 7:
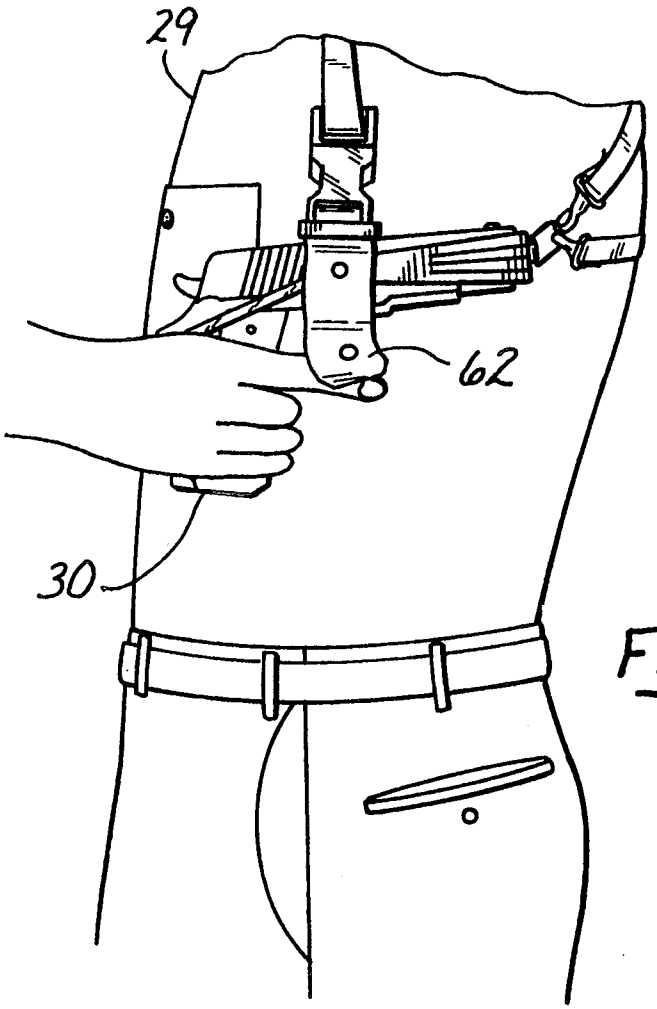
FIGS. 6–9 are pictorial views showing righthanded use of the pistol retention system and the manner in which the user draws the pistol.
Figure 9:
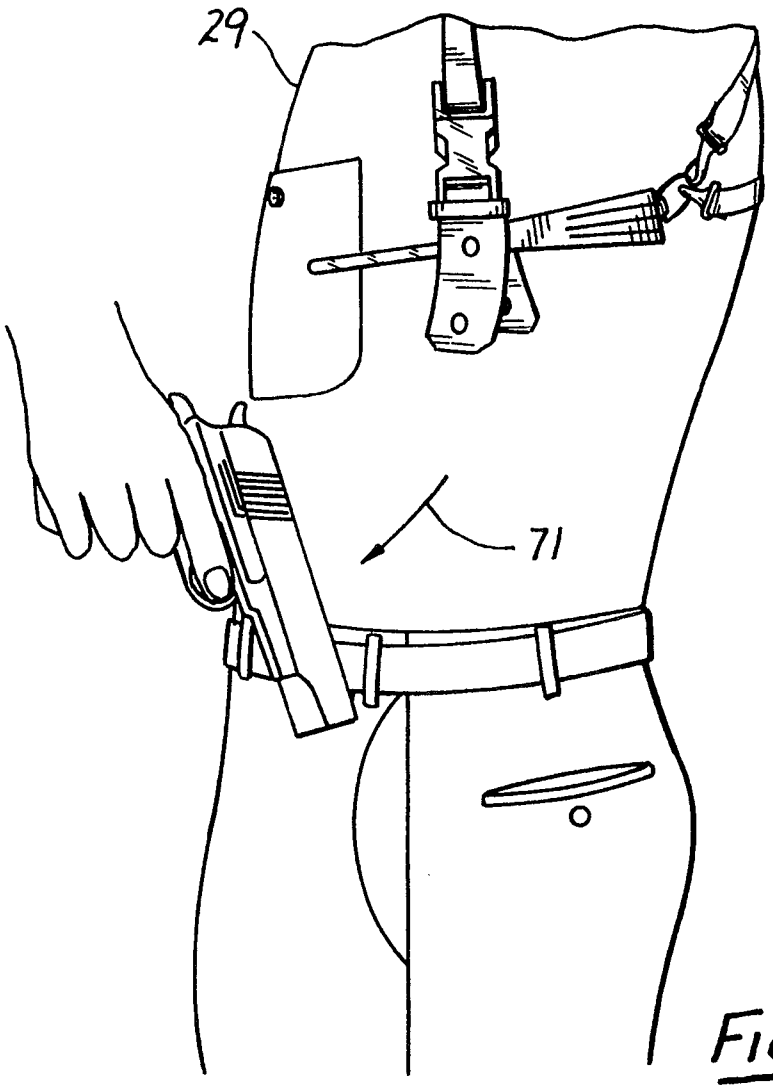
Figure 8:
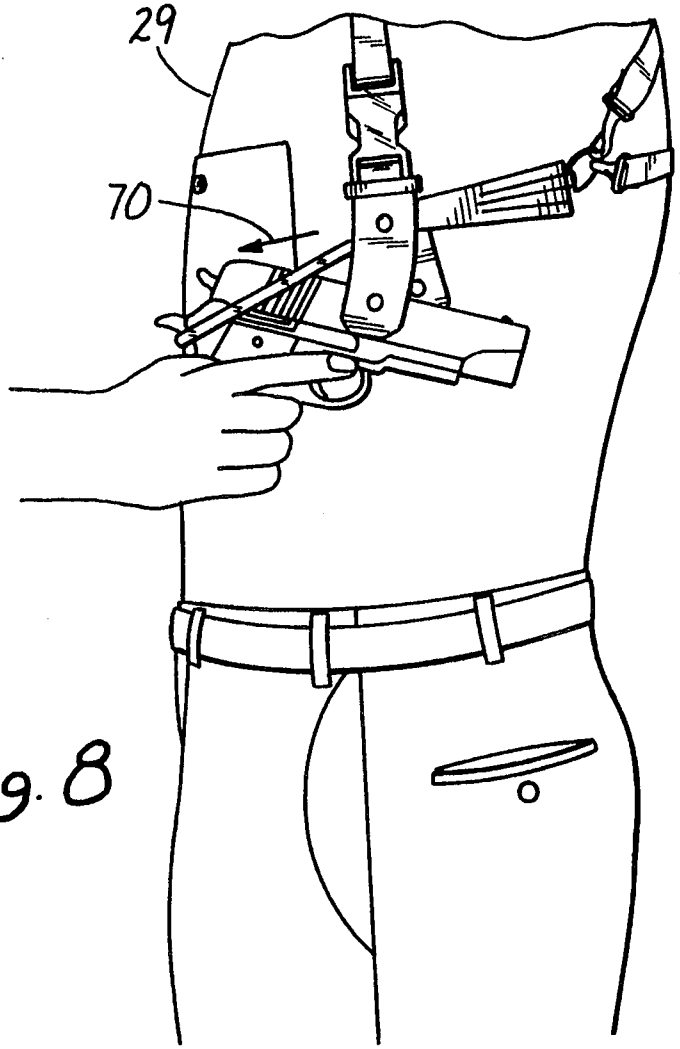

To draw the pistol 30, the person 29 grasps the pistol grip with his right hand as shown in FIG. 7. As he does so, he lifts the rightside portion 62 of the guard strap with his right index finger to unfasten it. That is done with the index finger extended. Next, he pulls on the pistol 30 in the direction of an arrow 70 in FIG. 8 while rotating the muzzle downwardly. That disengages the muzzle of the pistol from the protrusion 43 on the mainframe member. Continuing that motion as depicted by an arrow 71 in FIG. 9, frees the pistol 30 entirely from the pistol carrying device 11. To return the pistol 30 to the carrying device 11, the person 29 places the muzzle against the muzzle retainer portion, positions the retainer spring back over the rearward portion of the pistol, and refastens the guard strap through the trigger guard.

Thus, the invention breaks with traditional gunleather and other designs of the past to provide a lightweight, skeletonized, pistol retention system that mates a non-leather pistol carrying device with a removable shoulder harness. The pistol carrying device features modern materials in a conveniently fabricated, openframe, modular design. Together, the mainframe member, retainer spring, and guard strap effectively carry a pistol with non-leather advantages and significantly less weight and bulk. The quick-release, ambidextrous, one-size-fits-all shoulder harness quickly and conveniently converts to either lefthanded or righthanded use. Although an exemplary embodiment has been shown and described, one of ordinary skill in the art may make many changes, modifications, and substitutions without necessarily departing from the spirit and scope of the invention.

What is claimed is:

1. A pistol carrying device, comprising:

a mainframe member of rigid non-leather composition, an elongated spring member and a guard strap member that are connected to the mainframe member, and means for removably connecting a shoulder harness to the mainframe member for purposes of using the pistol carrying device to carry a pistol that has a rearward portion, a muzzle, a barrel with a bore that extends to the muzzle, a trigger intermediate the rearward portion and the muzzle, and a trigger guard;

the mainframe member including a muzzle retainer portion, a bore-engaging protrusion on the muzzle retainer portion, and elongated left and right arm portions that extend from the muzzle portion in spaced apart relationship;

the muzzle retainer portion being shaped and dimensioned to extend across the muzzle of the pistol transverse to the bore, the bore-engaging protrusion being shaped and dimensioned to protrude from the muzzle retainer portion and at least partially into the bore, the left arm portion being shaped and dimensioned to extend from the muzzle retainer portion along a left side of the pistol to a position above the trigger guard, and the right arm portion being shaped and dimensioned to extend from the muzzle retainer portion along a right side of the pistol to a position above the trigger guard;

the spring member having a first end connected to a rearward end of the left arm portion of the mainframe member, the spring member having a second end connected to a rearward end of the right arm portion of the mainframe member, and the spring member being shaped and dimensioned to extend across the rearward portion of the pistol in order to spring bias the pistol toward the muzzle retainer portion of the mainframe member;

the guard strap member including a strap of flexible material that has a leftside portion connected to the rearward end of the left arm portion and a rightside portion connected to the rearward end of the right arm portion, the strap including means for removably fastening the leftside and rightside portions together through the trigger guard in order to inhibit premature trigger finger contact of the trigger when the pistol is drawn; and the means for removably connecting a shoulder harness to the mainframe member including means for removably connecting the shoulder harness to the muzzle retainer portion and means for removably connecting the shoulder harness to the rearward ends of the left and right arm portions.

2. A pistol carrying device as recited in claim 1 wherein the muzzle retainer portion, the protrusion, and the left and right arm portions of the mainframe member are connected in integral one-piece construction.

3. A pistol carrying device as recited in claim 1, wherein the protrusion is tapered in order to fit at least partially into various caliber bores.

4. A pistol carrying device as recited in claim 1, wherein the guard strap member is dimensioned and arranged to extend over the pistol between the leftside and rightside portions.

5. A pistol carrying device as recited in claim 4, wherein the means for removably connecting the shoulder harness to the rearward ends of the left and right arm portions of the mainframe member includes a fastener device that is connected to a portion of the guard strap member extending over the pistol, which fastener device is arranged to receive a mating fastener device on the shoulder harness.

6. A pistol carrying device as recited in claim 1, wherein the means for removably fastening the leftside and rightside portions of the guard strap member together through the trigger guard includes:

mating first and second fastener components, each on a respective one of the leftside portion of the strap and the rightside portion of the strap; and first and second spacer components, each between the strap and a respective one of the first and second fastener components, the first and second spacer components having a thickness sufficient to enable the first and second fastener components to be fastened together through the trigger guard.

7. A pistol carrying device as recited in claim 6, wherein at least the first fastener component is composed of metal and the first spacer includes a grommet having a diameter greater than the first fastener component in order to inhibit metal-to-metal contact between the first fastener component and the pistol.

8. A pistol carrying device as recited in claim 1, wherein the means for removably connecting the shoulder harness to the muzzle retainer portion includes a ring fastener component connected to the muzzle retainer portion for receiving a hook fastener component on the shoulder harness.

9. A pistol carrying device as recited in claim 1, wherein the spring member includes:

an elongated helical spring of metal composition;

means in the form of first and second connector members for connecting the spring to the left and right arms of the mainframe member, each of which connector members includes a threaded shank that is screwed into a respective one of a first end portion and a second end portion of the spring; and means in the form of a jacket of non-metallic material extending over the spring for inhibiting metal-to-metal contact between the spring and the pistol and pinching of a user's skin.

10. A pistol carrying device as recited in claim 9, wherein the connector members take the form of eyelet screws.

11. A pistol carrying device as recited in claim 1, further comprising a shoulder harness arranged to be removably connected to the muzzle retainer portion and the left and right arm portions of the mainframe member.

12. A pistol carrying device as recited in claim 11, wherein the shoulder harness includes:

first, second, and third straps of flexible material, each strap having a first end portion, a second end portion, and an adjustable length between the first and second end portions, the first end portions of the straps being disposed in overlapping relationship so that the end portion of one strap is sandwiched between the end portions of the other two straps;

means for connecting the first end portions of the straps together pivotally in such overlapping relationship so that the straps may be pivoted to positions such that with the first ends of the straps placed on a selected one of a right shoulder and a left shoulder, the first strap extends downwardly in front of the selected shoulder, the second strap extends downwardly behind the selected shoulder, and the third strap extends from the selected shoulder, behind the neck, in front of the opposite shoulder, and behind the back to a position below the selected shoulder;

means for removably connecting the second end portion of the first strap to the left and right arm portions of the mainframe member; and means for removably connecting the second end portions of the second and third straps to the muzzle retainer portion of the mainframe member.

13. A pistol retention system as recited in claim 12, wherein the means for connecting the first end portions together pivotally includes a grommet extending through the first end portions.

* * * * *